United States Patent [19]

Verlinden et al.

[11] 4,137,340

[45] Jan. 30, 1979

[54] METHOD FOR FIXING ELECTROPHORETICALLY FORMED TONER IMAGES

[75] Inventors: Willy G. Verlinden, Edegem; Yvan K. Gilliams, Hever; Emile F. Stievenart, Hoboken, all of Belgium

[73] Assignee: AGFA-GEVAERT N.V., Mortsel, Belgium

[21] Appl. No.: 871,338

[22] Filed: Jan. 23, 1978

Related U.S. Application Data

[63] Continuation of Ser. No. 723,294, Sep. 14, 1976, abandoned.

[30] Foreign Application Priority Data

Sep. 16, 1975 [GB] United Kingdom ..... 38069/75

[51] Int. Cl.$^2$ ..... G03G 13/20; G03G 13/10

[52] U.S. Cl. ..... 427/16; 427/17; 427/22; 427/53; 427/207 A

[58] Field of Search ..... 427/16, 17, 22, 207 A, 427/53; 96/1-2, 1 LY; 355/10

[56] References Cited

U.S. PATENT DOCUMENTS

| | | | |
|---|---|---|---|
| 3,804,508 | 4/1974 | Mihajlou et al. | 355/3 R |
| 3,874,892 | 4/1975 | McInally | 427/22 |

*Primary Examiner*—Ronald H. Smith
*Assistant Examiner*—Stuart D. Frenkel
*Attorney, Agent, or Firm*—William J. Daniel

[57] ABSTRACT

A method for fixing a liquid toner image on a thermoadhesive layer of a recording material by irradiating such layer with high intensity short duration light pulses. The energy is sufficiently high to cause a partial melting of the layer so that the toner particles become absorbed thereon but the duration of the light pulse is sufficiently short to avoid a permanent deformation of the recording material itself. A favourable supplementary effect is that during irradiation a simultaneous evaporation of the residual toner liquid takes place.

9 Claims, No Drawings

METHOD FOR FIXING ELECTROPHORETICALLY FORMED TONER IMAGES

This is a continuation, of Ser. No. 723,294, filed Sept. 14, 1976 now abandoned.

The present invention is connected with electrophotography and related fields. More particularly, it is concerned with the fixing of toner images that are formed during processes of this type.

In recording processes that are based on the image-wise formation of electrostatic latent images, use is made of finely divided toner particles, which on account of their tribo-electric properties are attracted by the electrostatic latent images and on account of their colour make the latent images visible.

In the process known as xerography the toner particles adhere to so-called carrier beads as a consequence of the mutual attraction caused by the creation of electrostatic charges of opposite polarity existing between the carrier beads and the toner particles when the two are thoroughly mixed. This mixture is then brought into contact with a support bearing the electrostatic latent image and toner particles adhere to the support in those areas where the tribo-electric bond between the toner particles and the carrier beads is overcome. The toner image formed in this way is subjected to a fixing process in order to confer permanent qualities to the formed image. As toner particles for use in xerography are typically a composite mixture of a resin and an appropriate pigment, the most convenient methods for fixing the image consist in bringing the resin to a partially molten condition for example by heating, or by spraying adequate resin solvents over the image, so that a firm bond between the toner particles and the support is established.

Other processes make use of liquid toner compositions wherein toner particles are dispersed in an insulating liquid carrier. In such processes the resin is normally dissolved in the liquid carrier. The support bearing the electrostatic latent image is made to contact the surface of, or to dip into, the toner dispersion, and as a consequence thereof toner particles and part of the insulating liquid will adhere to the areas concerned. Fixing occurs by heating the support so that a firm bond is created between the toner particles and the support. In the meantime the residual amount of solvent may be evaporated. Fixing occurs by absorption and/or adsorption of the toner material to the surface.

Another fixing method makes use of a transparent foil, which is laminated over the toner image by means of pressure rollers or other devices known in the art.

The aforementioned methods have proved capable of giving excellent results for the development and fixing of line work images obtained on relatively porous supports such as paper, or supports whose surface has a fibrous structure, since this promotes adherence of the resin or foil.

When on the other hand latent electrostatic continuous images and more specifically such images are processed on a smooth support in the form of a high polymeric sheet or web, the above mentioned methods in general fail at least to some degree, since it is no longer possible to rely on adsorption and/or absorption phenomena in order to establish a firm bond between the toner image and its support.

Also the use of a transparent foil, which has been laminated, does not guarantee the absence of defects in the final image because the toner particles can become displaced when the foil is applied. In this way the information content of the image itself may be disturbed to a substantial extent. In some processes, such as the process disclosed in the U.S. Pat. No. 3,774,029 of Eric P. Muntz, Andrex P. Proudian and Paul B. Scott issued Nov. 20, 1973, and related to a process for ionography, where medical information is recorded the creation of such defects must be avoided at any cost.

It has been proposed to provide a dielectric material, such as polyethylene terephthalate, with a thermo-adhesive layer and to record the charge pattern onto said layer. Suitable thermo-adhesive layers in this connection are disclosed in our co-pending United Kingdom Patent Application No. 38070/75 filed Sept. 16, 1975, titled "Process for fixing toner images" and corresponding to U.S. application Ser. No. 723,189 filed Sept. 14, 1976. Liquid development of the electrostatic charge pattern thus formed may be carried out by an apparatus disclosed in our co-pending British Patent Application No. 44666/74 filed Oct. 15, 1974.

The following is an excerpt of the description found in British Application No. 38070 of 1975 of suitable thermo-adhesive layers, toner particles and other relevant information for practicing the invention of British Application No. 38070 of 1975:

"According to the invention a sheet of web material is provided, comprising a film support and a thermo-adhesive fixing layer defining a surface of said material, said layer comprising an organic polymeric material and having a surface resistance (measured as herein defined) above $10^{10}$ ohm/square, preferably above $10^{13}$ ohm/square and being free from blocking (as herein defined) at least up to 35° C., the melt of said thermo-adhesive fixing layer possessing a melt viscosity at 190° C. of not more than 120 P, preferably not more than 100 P and said thermo-adhesive fixing layer possessing an abrasion resistance (as herein defined) above 175 g at 20° C., preferably above 200 g.

"The invention also includes a process for fixing a toner image on sheet or web material, comprising the steps of image-wise depositing toner particles on a thermo-adhesive fixing layer that itself permanently adheres to a support, to constitute, at least in part, said sheet of web material and heating above 90° C. but preferably not above 130° C. at least those parts of said thermo-adhesive fixing layer corresponding with the toner image, but without reaching a temperature at which permanent deformation of the sheet or web material occurs, characterized in that said image is fixed on a thermo-adhesive fixing layer which has a surface resistance (measured as herein defined) above $10^{10}$ ohm/square, preferably above $10^{13}$ ohm/square and which is free from blocking (as herein defined) at least up to 35° C., the melt of the thermo-adhesive fixing layer composition forming a contact-angle with the toner particles smaller than 90°, said melt possessing a melt viscosity at 190° C. of not more than 120 P and the fixing layer possessing an abrasion resistance (as herein defined) at 20° C. above 175 g, preferably above 200 g.

"The invention also embraces such a process for fixing a toner image which comprises an electrostatic charge pattern formed through ionography on a receptor material comprising a said electrically insulating thermo-adhesive fixing layer that itself permanently adheres to a support, and developing said electrostatic charge pattern with toner particles, embedding said toner particles in the fixing layer mass by heating above 90° C. said layer, wherein melting of the fixing layer takes place without permanent deformation of the support, and wherein said fixing layer is free from blocking (as herein defined) at least up to 35° C., the melt of said fixing layer has a contact-angle (as herein defined) with the deposited toner particles smaller than 90°, said melt has a melt viscosity at 190° C. of not more than 120 P, preferably not more than 100 P and the fixing layer possesses an abrasion resistance (as herein defined) above 175 g.

"The surface resistance of the thermo-adhesive fixing layer of a material according to the invention is measured after conditioning the material at a relative humidity of 50%. The surface resistance measurements are performed by means of a pair of electrodes, both electrodes being 0.3 mm thick, have a width of 5 mm and are placed in parallel position at a distance of 10 mm between each other. During the measurements a tension of 85 V is applied between the two electrodes.

"The thermo-adhesive fixing layer is to be free from blocking at temperatures at least up to 35° C., which means that when two of the present identical thermo-adhesive fixing layers are pressed against each other in vertical position with a pressure of 100 g/sq.cm, whilst they are heated to a temperature of 35° C., the two layers do not adhere to each other and easily separate by simple gravity.

"The abrasion resistance is determined by drawing a sapphire pin over the fixing layer while charging the pin with an increasing weight. The abrasion resistance is the lowest weight at which at 20° C. the sapphire pin leaves a visible scratch on the layer. Depending on the nature of the polymer used in forming the fixing layer and depending also on the nature of possible additives, abrasion resistances above 175 g and preferably higher than 200 g are noticed for thermoadhesive layers with very good fixing results.

"In order that a toner image formed on a sheet or web material according to the invention may have best lasting properties, it is desirable that the toner particles should be embedded in the fixing layer, and accordingly, the melt of such layer should form a contact angle of less than 90° with deposited toner particles. The contact angle depends on the wettability of the toner particles by the molten thermo-adhesive fixing layer composition, and accordingly depends on the composition both of the layer and the toner particles. The smaller the contact angle, the better the wettability will be, a contact angle of 0° defining complete wettability and a contact angle of 180° complete repellency. In fact, for a given fixing layer composition, various toner materials while giving contact angle values of the same order of magnitude will give differing values. The Applicants therefore propose a standard test for measuring the contact angle afforded by different fixing layer compositions which resides in the use of the toner material manufactured as follows.

"In a ball-mill with a capacity of 140 1 filled with 105 kg of steatite balls (diameter : 10 mm, specific gravity : 2.34) the following products were introduced successively :

— 2.1 kg of 30% of solution of NEOCRYL B 702 (trade-name) in ISOPAR G (trade-name)
— 0.2 1 of 5 % solution of zinc 2-hexyldecyl sulphonate in isodecane
— 2.375 kg of PRINTEX G (trade-name)
— 0.125 kg of HELIOECHTBLAU HG (trade-name)
— 6 1 of isododecane.

"NEOCRYL B702 is the trade-name of a copolymer of isobutyl methacrylate and stearyl methacrylate comprising about 0.2% of methacrylic acid, marketed by Polyvinylchemie, The Netherlands. ISOPAR G is the trade-name for an aliphatic hydrocarbon having a boiling range of 160–175° C. and a KB value of 27, marketed by the Esso Standard Oil Company. PRINTEX G is the trade-name of a carbon black pigment marketed by DEGUSSA. HELIOECHTBLAU HG is the trade-name of Bayer A.G. for a copper phthalocyanine, C.I. 74,160.

"This mixture was ground at 42 rpm for 15 h and thereupon diluted with isodecane so as to obtain a toner concentrate in 16% by weight concentration.

"To measure the contact-angle a uniform layer of the toner particles is formed on a heat-resistant substrate, which is placed in an oven and heated to 120° C. From a pipette a drop of molten thermo-adhesive fixing layer composition, heated to the same temperature, is deposited upon the toner layer. The oven has been associated with an optical bench to make a series of photographs of the deposited drop as a function of time. Upon enlarging these photographs it is possible to determine the contact-angle of the molten material with the layer of toner particles as a function of time. The angle measured at equilibrium is the contact-angle.

"In the process according to the invention the toner image is preferably formed by electrophoretically depositing toner particles upon the thermo-adhesive fixing layer. The image is fixed by embedding the toner particles in the molten thermo-adhesive layer. For fast fixing, the toner particles should be easily wetted by the molten thermo-adhesive fixing layer composition, which is attained when the contact-angle of the melt with the toner particles is smaller than 90°.

"The use of self-fixing toner materials is not excluded by the present invention. However if such materials are used they must be selected for compatibility with the fixing layer composition, and in this case the contact angle will necessarily be less than 90°.

"The melt viscosity of the thermo-adhesive fixing layer depends on the fixing temperature, on the molecular weight of the polymer used in forming the thermo-adhesive fixing layer, on its chemical composition, and on the amount of possible additives present in the fixing layer composition, such as plasticizers. In all our experiments the melt viscosity has been measured with a DRAGE viscosimeter of Chemisches Institut Dr. A. B. Epprecht, Zurich, Switzerland. In this apparatus the shear stress (expressed in dyne/sq.cm), which depends on the melt viscosity of the polymer, is graphically registered versus the corresponding speed gradient D (expressed in $s^{-1}$), which depends on the angular speed of a rotating spindle in the apparatus and also on the difference in diameter between the spindle and the cup wherein the spindle rotates. The melt viscosities of poly(meth)acrylates and polyesters which, as will be shown further, are to be used preferentially in the process of the invention to form the thermo-adhesive fixing layer, are of Newtonian character at least in the molecular weight ranges suitable for the process of the invention. Accordingly, the shear stress T, which is measured, increases linearly with increasing speed gradient D. Depending on the magnitude of speed gradient D (between 27 $s^{-1}$ and 531 $s^{-1}$) the following relation applies:

$$\eta = \tau/D \text{ (expressed in P)}$$

wherein $\eta$ represents the melt viscosity.

"Measuring of the melt viscosity with the DRAGE apparatus according to the test proposed occurs at 190° C. At that temperature the viscosity of the polymer melt is much lower than it would be at the preferred fixing temperature range of 90–130° C. so that the temperatures of the apparatus and of the polymer melt will recover their balance much faster and the measurements can be effected much more rapidly.

"As a result of the linear logarithmic relation between melt viscosity and temperature for polymers of suitable chemical composition it is easy to determine the melt viscosity at 90–130° C. by means of a simple diagram. In Example 1 hereinafter the melt viscosity at 190° C. of a copolyester of cyclohexane dimethanol and a 80:20 mixture of phthalic acid and terephthalic acid is 98 P, the copolyester having an inherent viscosity of 0,22 dl/g. The diagram presented in FIG. 1 gives for this same copolyester the melt viscosities expressed in P at different temperatures, and from this diagram can be deduced that at the preferred normal fixing temperature of about 120° C. the melt viscosity for the above copolyester will be about 2500 P.

"The polymers used for forming the thermo-adhesive fixing layers have to possess the desired melt viscosity characteristics.

"Indeed, the time required to embed the toner particles in the thermo-adhesive fixing layer and to fix the toner image therein depends on the melt viscosity of the thermo-adhesive fixing layer composition. The fixing time will be shorter as the melt viscosity is lower. This can be achieved by two different procedures.

"In order to make a thermo-adhesive fixing layer for performing the invention it is possible to make use of polymers having a range of molecular weights. Low molecular weight polymers may have a suitably low melt viscosity, but as the molecuar weight reduces, generally speaking, the abrasion resistance and blocking temperature also reduce. It is accordingly desirable to choose a polymer which affords a suitable compromise between melt viscosity and fixing time on the one hand and abrasion resistance and blocking temperature on the other hand.

"However it is also possible to use polymers having a considerably higher molecular weight. In general, these polymers possess higher glass transition temperatures and higher inherent viscosities, so that good abrasion resistances and blocking temperatures of the fixing layers are guaranteed. When these higher molecular weight polymers are used, the melt viscosity of the molten thermo-adhesive fixing layer may be kept below 100 P at 190° C. by the addition to the coating layer composition of plasticizers or thermo-solvents. The expression "thermo-solvents" is used to denote substances that are solid at room temperature and that at the fixing temperature are liquid and behave as a solvent or plasticizer for the thermo-adhesive polymer. With these thermo-solvents, even at the low fixing temperature of 90–130° C., a fixing time of the toner particles of 1 to 20 s can be reached when using higher molecular weight polymers which by themselves would not possess a sufficiently low viscosity to fix the toner particles within that required time. It will be appreciated that a short fixing time is very advantageous.

"In the first embodiment described above the thermo-adhesive fixing layer is formed from a thermoplastic organic polymer without the addition of thermo-solvents thereto. In that case, the glass transition temperature (Tg) of the polymer will practically be the same as that of the thermo-adhesive fixing layer, so that the Tg of the polymer has to be at least 35° C. to ensure that the blocking temperature of the layer be also at least 35° C. For such a Tg of at least 35° C. is needed that the inherent viscosity of the polymer attain a certain minimum value, which for each separate polymer can easily be determined. Moreover, since inherent viscosity and molecular weight are directly bound to each other, this means that in order to have a Tg of at least 35° C., the molecular weight of the polymer be not lower than a certain minimum.

"However, when according to the above described second embodiment thermo-solvents are mixed with the thermoplastic organic polymer, the Tg of the thermo-adhesive fixing layer as a whole will be lower than the Tg of the thermoplastic polymer itself, so that the Tg of the polymer is to be higher than 35° C. to ensure that the whole fixing layer has a blocking temperature of at least 35° C.

"The amount of thermo-solvent may vary between 10 and 50% by weight of the thermo-adhesive polymer. Preferably the amount of thermo-solvent used is kept as low as possible to avoid exudation of the thermo-solvent from the thermo-adhesive layer and to keep the blocking temperature of the fixing layer at an acceptable level of at least 35° C.

"Suitable thermo-solvents are e.g.:

chlorinated di- and polyphenyls such as the AROCLOR's (trade-name of Monsanto Chemical Company, St. Louis, Mo., USA)

diphenyl o-phthalate m-terphenyl chloroparaffines cis- and trans-cyclohexanedimethanol benzoate SANTICIZER lH (trade-name of p-(cyclohexylsulphonyl)-toluene marketed by Monsanto Chemical Company, St. Louis, Mo., USA)

"The thickness of the thermo-adhesive layer may vary between 1 and 20 μm, preferably between 3 and 10 μm, depending on the particle diameter of the deposited toner.

"Any suitable mixture of binder resins and possibly of thermo-solvents may be used in the toner receptor material of this invention provided the charge-receiving thermo-adhesive fixing layer retains the applied charge for a sufficiently long time to enable the toner development of the charge pattern to take place.

"According to a preferred embodiment good results have been obtained by using in the composition of the thermo-adhesive fixing layer linear polyesters resulting from the polycondensation of at least one aromatic dicarboxylic acid, taken from the group consisting of terephthalic acid, isophthalic acid and phthalic acid, optionally combined with a minor amount of a saturated aliphatic dicarboxylic acid or of mixtures thereof, with a diol taken from cyclohexanedimethanol and alkylene glycols wherein the alkylene group has 2 to 6 carbon atoms.

"Suitable polyesters are obtained, e.g., by the polycondensation of ethylene glycol with a mixture of phthalic acid and terephthalic acid, the ratio of phthalic acid in the copolyester varying from 40 to 80 mole % and that of terephthalic acid from 60 to 20 mole %. Also suitable are the copolyesters of cyclohexanedimethanol with phthalic acid and terephthalic acid, the percentage of terephthalic acid being about 20 mole %. Other suitable polyesters are the polycondensation products of cyclohexane-dimethanol with a mixture of terephthalic acid and glutaric acid and the polycondensation products of cyclohexanedimethanol with phthalic acid alone.

"In all these polycondensation products the molecular weights are chosen in such a way that the above given requirements of contact-angle, melt viscosity, abrasion resistance and blocking temperature are met. In general the inherent viscosity of the polyesters has to be lower than 0.3 dl/g in case the polyesters are used as such in the formation of the thermo-adhesive layer, otherwise the melt viscosity would be too high. However, if thermo-solvents such as SANTICIZER lH (trade name) are added to the coating composition for the thermo-adhesive layer in an amount between 10 and 50% by weight of the polyester, the inherent viscosity of the polyester may be much higher, so that the abrasion resistance of the fixing layer will be much higher too.

"Equally suitable are unsaturated polyesters obtained by reacting a bis-phenol such as 2,2-bis(4-hydroxyphenyl)-propane(bis-phenol A) with fumeric or maleic anhydride. "According to another embodiment good results are also obtained with homopolymers of benzyl methacrylate, furfuryl methacrylate and alkyl methacrylates and with copolymers of alkyl methacrylates and alkyl acrylates, more especially those polymers with a glass transition temperature higher than 35° C., whereby all these homopolymers and copolymers, possibly together with a thermo-solvent produce polymeric coatings that satisfy the above requirements of blocking temperature and abrasion resistance. It is to be understood that in the copolymers of alkyl methacrylates and alkyl acrylates also minor amounts, e.g. up to 10% by weight, of other monomers may be present, e.g. acrylamide.

"In general it is also required that the melt viscosity of the thermo-adhesive fixing layer be at most 100 P when measured at 190° C. However, when homopolymers and copolymers of methacrylates and acrylates are applied as main constituents for the thermo-adhesive fixing layer, those producing fixing layer compositions having melt viscosities below 50 P are preferred because they keep the time necessary to fix the toner particles within practical limits.

"From our experience it has been deduced that homopolymers of alkyl acrylates possessing short-chain alkyl side-substituents are not suitable for the purposes of this invention. Their glass transition temperatures are much too low so that layers produced therewith are not free from blocking below 35° C.

"Homopolymers of alkyl methacrylates with short-chain alkyl side-substituents, e.g. polymethyl methacrylate and polyisobutyl methacrylate, possess much higher glass transition temperatures, thus higher blocking temperatures, but also higher melt viscosities. They can only be used for the purpose of the invention when they are mixed with a sufficient quantity of thermo-solvent. In the case of polymethyl methacrylate, however, the quantity of thermo-solvent needed for lowering the melt viscosity below about 50 P at 190° C. is so high that the coatings produced from the mixture become unstable. Indeed, for a polymethyl methacrylate having an inherent viscosity of 0.30 dl/g, the amount of SANTICIZER 1H (trade-name) needed is 60 parts by weight for 40 parts by weight of polymer. Upon storage of the layers at room temperature the thermo-solvent is gradually lost by exudation.

"Polyethyl methacrylate possibly mixed with a thermo-solvent is suitable for the purposes of the invention. On the contrary higher straight-chain alkyl polymethacrylates such as poly-n-propyl methacrylate and poly-n-butyl methacrylate cannot be used since their glass transition temperatures are too low. They form layers with insufficiently high blocking temperature. In contrast therewith, the homopolymers of branched-chain alkyl methacrylates such as isopropyl, isobutyl, s- and t-butyl methacrylate are suitable, possibly mixed with thermo-solvents, since their glass transition temperatures exceed 35° C.

"Particularly good results are obtained with polymers formed from long-chain alkyl methacrylates wherein the alkyl groups comprise up to 22 carbon atoms. These long-chain alkyl groups are responsible for the crystalline behaviour of the polymers and copolymers thereof. However, since the homopolymers of these long-chain alkyl methacrylates form layers whose abrasion resistance is insufficient, it is preferred to use these long-chain alkyl methacrylates in the form of their copolymers with short-chain alkyl methacrylates wherein the alkyl groups comprise 1 to 6 carbon atoms.

"In another series of experiments it has been established that the addition to the coating composition for the thermo-adhesive fixing layer of a small quantity of a wax, e.g. from 1 to 5% by weight calculated on the weight of polymer present, resulted in a considerable increase in the mechanical resistance of the fixing layer against scratching. Suitable waxes are e.g.:

CASTORWAX: trade-name of the Baker Castor Oil Co., USA

MONTANWAX

ALBACER: trade-name of Glycol Chemicals, Williamsport, USA

HOECHST WACHSE and CHLORPARAFFIN 40-FLUSSIG, trade-names of Farbwerke Hoechst AG, Frankfurt/M., Western Germany SANTOWAX-P: trade-name of Monsanto Chemical Company, St. Louis, Mo., USA.

"Especially with CASTORWAX very good results have been obtained. The addition to the coating composition of the thermo-adhesive fixing layer of 0.1 to 0.5 g of CASTORWAX (trade-name) per 10 g of polymeric binding agent in the layer resulted in a greatly increased abrasion resistance of the layer. The blocking temperature was considerably increased and the fixing time was markedly shortened.

"The support for the thermo-adhesive fixing layer is preferably a smooth, non-porous sheet or web material, which — if transparent — may be made e.g. of cellulose nitrate, cellulose ester, e.g. cellulose triacetate, cellulose acetate-butyrate, polyvinylacetal, polystyrene, polymethacrylic acid esters, polysulfones, polycarbonates, or highly polymeric linear polyesters, e.g. polyethylene terephthalate. For special purposes, sheets of paper, e.g. of glassine paper, may also be used as support for the thermo-adhesive fixing layer "The above named film supports being highly transparent for visible light allow the inspection of the toner image with light projected through the image-containing material e.g. on a light-table or in a transparency projector (slide projector).

"Preferred are the polyethylene terephthalate film supports because of their resistance to moisture and heat and their high mechanical strength obtained after biaxial orientation and heat-setting of the film. Although the thermo-adhesive layer may be applied directly to the support, particularly strong adherence of the thermo-adhesive layer to the resin support is obtained when the hydrophobic resin support, preferably a polyethylene terephthalate support, is subbed with a layer directly adhering to the said hydrophobic film support and substantially consisting of a copolymer formed from 45 to 99.5% by weight of at least one of the chlorine-containing monomers vinylidene chloride and vinyl chloride, from 0.5 to 10% by weight of at least one ethylenically unsaturated hydrophilic monomer, and from 0 to 54.5% by weight of at least one other copolymerisable ethylenically unsaturated monomer.

"The vinylidene chloride copolymer may be formed from vinylidene chloride and/or vinyl chloride and hydrophilic monomeric units alone in the ratio indicated above, but up to 54.5% by weight of other recurring units, e.g. acrylamides, methacrylamides, acrylic acid esters, methacrylic acid esters, maleic esters and/or N-alkylmaleimides, may also be present.

"The preparation of said vinylidene chloride copolymers suited for said subbing layer is described, e.g., in the United Kingdom Patent No. 1,234,755.

"Electrostatically chargeable materials for use in various electrostatographic recording techniques are provided on the rear-side with an electroconductive coating.

"According to an embodiment in the toner fixing process of the present invention a toner image receptor material is used, which at the side opposite to the fixing layer contains an antistatic layer applied from an aqueous coating composition.

"Preferred recording materials according to the present invention for use in an ionographic imaging chamber as described in the U.S. Pat. No. 3,859,529 contain at their rear-side a coating having a surface resistance of at least $10^9$ ohms/sq. during the formation of the electrostatic image and which can be lowered preferably below $10^6$ ohms/sq during electrophoretic development. Suitable rear-side coatings for that purpose are photoconductive layers whose surface resistance can be lowered by exposure to ultraviolet radiation and/or visible light.

"Other suitable rear-side coatings have such composition that their surface resistance fan be lowered by moistening with water.

"When the support is a film of polyethylene terephthalate use may be made of the method described in our United Kingdom Patent Application No. 21,324/74. Herein an antistatic layer is applied from an aqueous coating composition on an unstretched or only monoaxially stretched polyester film support. Thereafter the antistatic layer is dried and the film is stretched biaxially or in a direction perpendicular to that of the first stretching operation, followed by heatsetting. The aqueous composition comprises 30 to 80% by weight of an electroconductive product, 10 to 40% of a stretch-improving agent and 10 to 40% of an inert filler material. The electroconductive product may be a polymeric material such as polystyrene sulphonic acid or a low molecular weight antistatic compound such as stearamidopropyl dimethyl-β-hydroxyethyl ammonium nitrate. Most suitable as stretch-improving agents are aliphatic polyhydroxy compounds and as filler material are suitable e.g. polyethylene and amorphous silicon dioxide obtained by the hydrolysis in situ of silane compounds.

"All commercially available toners can be used, the only restriction being that the contact-angle between molten thermo-adhesive fixing layer composition and toner particles is smaller than 90° C.

"The toner particles are preferably of the 'wet' electrophoretic type incorporating a resin or resin mixture.

"The preparation and composition of such toner particles suitable for use in electrophoretic development and fixing according to the present invention is described, e.g., in the United Kingdom Patents Nos. 1,151,141 and 1,312,776, in the United Kingdom Patent Application No. 8689/74 corresponding with German Patent Application No. 2,502,933 and in the published German Patent Applications (DOS) Nos. P 2,334,353 and P 2,333,850. Normally the electrophoretic developer material consists essentially of finely divided resin-coated pigment (toner) particles dispersed in an insulating liquid having a dielectric constant of not more than 3.

"Particularly useful materials for electrophoretic development and fixing according to the present invention contain a polymer essentially consisting of methacrylic acid esters, and most conveniently polymers of acrylic or methacrylic acid esters of hydrogenated abietyl alcohol as described in United Kingdom Patent Application No. 8689/74 corresponding with German Patent Application No. 2,502,933. The pigment or colouring agent contained in the toner particles may be any of the pigments or dyestuffs commonly employed for that purpose.

"Useful toners for electrophoretic development are also described in our United Kingdom Patent Application No. titled 'Improved electrophoretic developer'.

"The way in which the toner image is developed on the thermo-adhesive layer is in no way critical. This can be done by transfer from a photoconductive plate or drum (indirect electrophotgraphy) or by a process wherein the latent image is directly recorded on the thermo-adhesive layer as by ionography as described in U.S. Pat. No. 3,774,029.

"The thermo-adhesive fixing layer may be heated in different ways, e.g. by convection heat or infrared irradiation. Depending on the heating energy supplied during the fixing step and the constitution of the thermo-adhesive layer, the total fixing time will vary between 5 and 20 s, where e.g. at least 3 s are needed to melt the thermo-adhesive layer and at least 2 s to embed the toner particles that are deposited in an optical density range from 0.2 to 3. Of course, the actual duration of the fixing will largely depend upon the melt viscosity of the molten fixing layer. This melt viscosity has to be lower than 100 P at 190° C., but for some polymers, as is the case with the polymers of alkyl methacrylates mentioned above, it is preferable that the melt viscosity be much smaller and even be lower than 50 P at 190° C. in order to keep the fixing time within acceptable limits."

It has been proposed to fix the image so obtained by heating the thermo-adhesive layer to 100°-130° C. for a relatively long period, which is sufficient to cause the melting of the thermo-adhesive layer and created thereby a firm relationship between the surface of the layer and the toner particles adhered thereto. The time necessary to carry out the process seriously limits the working cycle frequency of the system.

It has now been found that fixing may also be carried out by means of short duration pulses of flash light, so that the images can be fixed in a very short time without deformation of the recording material.

According to the invention a method is provided for fixing a toner image to areas of a thermo-adhesive surface of a recording material, containing, e.g., a thermo-adhesive layer on a support, comprising the step of irradiating that surface with one or more short duration high-energy light pulses in such a way that the energy of a said pulse is sufficiently high to cause at least melting and/or deformation of the irradiated area of the surface so that the toner particles are partly absorbed by and/or adsorbed on said molten and/or deformed area, thereby establishing a permanent bond, whereas the duration of the pulse is sufficiently short to avoid permanent deformation of the recording material.

The advantage of the fixing method as described above compared with conventional infrared heating methods resides in the fact that because of the very short time of the flash exposure there is no diffusion of the liberated heat into the support, so that the heating and consequently curling of said support is smaller than in conventional fixing methods. As a consequence only the thermo-adhesive surface layer has to be cooled. By choosing a condensor battery of sufficient capacity to store the required energy and a loading circuit having a time constant which is small enough, fixing may be carried out very quickly.

Also because of the fact that the power consumed is only used for the thermo-adhesive surface layer and the toner image to be heated, the energy loss by absorption by the support may practically be neglected, so that the power requirements are smaller than when conventional heating means are employed.

Preferably the toner is applied to the thermo-adhesive surface as a dispersion of toner particles in a liquid carrier, and preferably also, the light pulse is of sufficient energy to cause the evaporation of any residual liquid carrier deposited on the surface during development of the toner image.

Advantageously the energy dissipated by the light pulse is at least 0.8 $W.s.cm^{-2}$ (Watt.second per sq.cm) and preferably lies in the range 0.8 $W.s.cm^{-2}$ to 3.0 $W.s.cm^{-2}$.

The duration of a light pulse may conveniently be determined by reference to the time during which the power output of the light source exceeds a certain proportion of the peak power output for that pulse. Preferably the power output exceeds $\frac{1}{3}$ of the peak power output for that pulse for not more than 1 ms, and preferably for between 0.2 ms and 0.8 ms.

When a thermo-adhesive layer applied, e.g., to a polyethylene terephthalate film support, is irradiated with a pulse of such energy and duration it is found that the temperature of the upper surface of the thermo-adhesive layer can be increased sufficiently (preferably in the range 200°–500° C.) that the layer becomes tacky and toner particles consequently adhere thereto. Because of the short duration of the pulse, heat transmission through the layer to the film support is insufficient to cause permanent deformation of the support. Furthermore, the energy output occurs in a substantially adiabatic fashion so that heat transfer to ambient air may be neglected. Thus, neglecting the energy required to evaporate any residual liquid carrier which may be present on the layer, substantially the whole energy output may be adsorbed by the thermo-adhesive layer and this permits simple regulation of energy output.

In apparatus for carrying out the method, a support bearing a thermo-adhesive layer onto which a toner image has been deposited as a consequence of electric charge attraction, preferably performs a relative motion with respect to the light source. It is convenient for the image-bearing support to be transported in front of a stationary light source. The light source is preferably a discharge tube mounted in the focus or focal line of a parabolic, double parabolic or elliptic reflector, which has been pebbled in order to render the reflected light more diffuse in nature.

The flash tube may conveniently be arranged to discharge at a frequency of between 0.3 and 1 Hz, and the size of the reflector and speed of transport of the recording material are preferably arranged so that there is a small overlap between areas irradiated by successive light pulses.

The concentration and the sudden release of high energy has another favourable consequence in that the residue of highly insulating liquid in which the toner was previously dispersed is evaporated in the meantime.

In a preferred embodiment the flash lamp used was the type XL 615/10/40 sold by E.E.V. Company Ltd. It has a diameter of 12 mm and operates at a working voltage of 3–5 kV. The voltage of the ignition electrode was about 25 kV. The flash lamp was placed in the focal line of a linear parabolic reflector, the inner surface of which has been pebbled. The opening of the reflector facing the toner image was 60 mm × 355 mm. The energy which was dissipated at each exposure was 2 $W.s.cm^{-2}$ and the pulse repetition frequency amounted to 1 exposure per 3 s. In so doing, the dimensions of the apparatus may be substantially decreased and the power requirement for the flash unit reduced.

A toner image having an optical density D equal to 2.8 before fixing was fixed. After the fixing cycle the density decrease amounted only to 0.1 density unit. Development had been carried out with an apparatus according to our co-pending application No. 44666/74, already mentioned hereinbefore, which enables the processing of halftone images.

The support travelled at a continuous speed of 2 $cm.s^{-1}$ so that each time when the lamp is ignited a small overlapping occurs.

The images obtained after fixing show a good resistance to abrasion and the halftone quality is in no way decreased.

We claim:

1. A process for electrophoretically depositing and fixing an electrophoretic toner particle image on a recording material comprising a web support having permanently adhered thereto a thermo-adhesive fixing layer defining the surface on which said toner image particles are deposited, said process comprising the steps of passing said recording material with an electrostatic charge pattern present in said thermo-adhesive fixing layer through an electrophoretic developing liquid comprising finely divided resin-coated pigment particles suspended in an insulating carrier liquid to imagewise deposit said particles on said fixing layer, said resin-coated particles being adapted to form with said thermo-adhesive layer when the latter is in melted condition a contact angle smaller than 90° so that said particles will be wet by molten thermo-adhesive layer, and exposing said surface to at least one short duration high energy light pulse emitting an amount of energy of at least 0.8 $W.s.cm^{-2}$ which has a power output exceeding $\frac{1}{3}$ of its peak power output for a time not longer than 1 ms so as to effect sufficient melting of a surface substratum of the thermo-adhesive layer thus irradiated as to cause said toner particles to become at least partially absorbed into said melted substratum while simultaneously evaporating residual carrier liquid, the duration of said pulse being insufficient to permit diffusion of substantial heat from said fixing layer into said support, whereby permanent deformation of the recording material is avoided and energy consumption is minimized, and allowing said imaged layer to cool and solidify with said image particles embedded in said layer, said thermo-adhesive fixing layer comprising an organic polymeric material and being characterized by a surface resistance above $10^{10}$ Ohm/square, freedom from blocking at temperatures at least up to 35° C., a melt viscosity at 190° C. of not more than 120 P and an abrasion resistance in excess of 175 g at 20° C., said blocking, abrasion resistance, melt viscosity and contact angle values being determined according to the respective tests described in the specification.

2. The method of claim 1 wherein said recording material surface is exposed in sequential steps, each step covering a section of the overall surface area which partially overlaps an adjacent section covered in a preceding step.

3. The method of claim 1 wherein said light pulse is of diffused radiation.

4. A method according to claim 1, wherein the energy emitted by said light pulse is at most 3.0 $W.s.cm^{-2}$.

5. A method according to claim 1, wherein the power output of the light pulse source exceeds $\frac{1}{3}$ of the peak power output for the pulse for between 0.2 and 0.8 ms.

6. A method according to claim 1, wherein the thermo-adhesive layer is coated on an optically transparent support.

7. A method according to claim 6, wherein said optically transparent support is a sheet or web of polyester.

8. A method according to claim 1, wherein a flash lamp is the source of said light pulses and said flash lamp and said thermo-adhesive surface are moved relative to each other to carry out a series of such exposures.

9. A method according to claim 8, wherein the thermo-adhesive surface is transported in front of said flash lamp which remains stationary.

* * * * *